US005370719A

United States Patent [19]

Teruuchi et al.

[11] Patent Number: 5,370,719

[45] Date of Patent: Dec. 6, 1994

[54] WEAR RESISTANT TITANIUM CARBONITRIDE-BASED CERMET CUTTING INSERT

[75] Inventors: Kiyohiro Teruuchi; Fumihiro Ueda, both of Saitama; Niro Odani, Ibaragi, all of Japan

[73] Assignee: Mitsubishi Materials Corporation, Tokyo, Japan

[21] Appl. No.: 153,377

[22] Filed: Nov. 16, 1993

[30] Foreign Application Priority Data

Nov. 16, 1992 [JP] Japan ..... 4-330116

[51] Int. Cl.[5] ..... C22C 29/02

[52] U.S. Cl. ..... 51/309; 75/231; 75/237

[58] Field of Search ..... 51/295, 309; 75/231, 75/237

[56] References Cited

U.S. PATENT DOCUMENTS

| | | | |
|---|---|---|---|
| 4,212,670 | 7/1980 | Shveikin et al. | 75/237 |
| 4,778,521 | 10/1988 | Iyori et al. | 75/237 |
| 4,942,097 | 7/1990 | Santhanam et al. | 75/230 |
| 5,030,038 | 7/1991 | Ariura | 75/230 |
| 5,053,074 | 10/1991 | Buljan et al. | 75/237 |
| 5,089,047 | 2/1992 | Buljan et al. | 75/237 |
| 5,149,361 | 9/1992 | Iyori et al. | 75/237 |

*Primary Examiner*—Mark L. Bell
*Assistant Examiner*—Deborah Jones
*Attorney, Agent, or Firm*—Morrison Law Firm

[57] ABSTRACT

A TiCN-based cermet cutting insert superior in toughness with improved wear resistance includes a binding phase and at least two hard dispersion phases. One hard dispersion phases includes a core of TiCN while the other hard dispersion phases includes a core of a carbonitride solid solution of Ti and one of a V,Hf,Cr, Ta,Nb, Zr, W and Mo.

7 Claims, No Drawings

WEAR RESISTANT TITANIUM CARBONITRIDE-BASED CERMET CUTTING INSERT

BACKGROUND OF THE INVENTION

The present invention is directed to a cutting insert. More particularly, the present invention is directed to a titanium carbonitride-based cermet cutting insert (hereinafter referred to as "TiCN"), which exhibits superior wear resistance and toughness. Such a cutting insert is also longer lasting and resistant to damage such as chipping and breaking of the cutting edge while in continuous and discontinuous use.

In recent years, a demand for factory automation has created a need for longer lasting cutting inserts which are tough and wear resistant.

In an attempt to fulfill this demand for superior cutting inserts, Japanese Laid Open Patent Publication No 62-170452 and 63-83241 proposes a TiCN-based cermet cutting insert which essentially contains from about 5 to about 30 vol% of a binding phase, which is mainly composed of one of Co and Ni, with the balance consisting of a hard dispersion phase.

The hard dispersion phase includes a duplex and/or a triplex structure with a core formed of a carbonitride solid solution of Ti and one of a V, Hf, Cr, Ta, Nb, Zr, W and Mo (hereinafter referred to as ("Ti,M)CN").

However, these prior art TiCN-based cermet cutting inserts have been unable to fulfill the abovementioned demand because of their inability to withstand the demands of continuously cutting steel in an industrial setting. Notwithstanding the toughness of these prior art cutting inserts, such cutting inserts are prone to extensive breakage and chipping of their cutting edges while in continuous use.

In order to overcome the aboveintentioned drawback associated with the use of prior art TiCN-based cermet cutting inserts in an industrial setting, the present invention aims at providing a TiCN-based cermet cutting insert which exhibits superior toughness and wear resistance. Additionally, the TiCN-based cermet cutting insert of the present invention aims at increasing the life of the cutting insert, and substantially improving its resistance to chipping and breaking of the cutting edge while continuously cutting steel.

OBJECTS AND SUMMARY OF THE INVENTION

Accordingly, it is an object of the present invention to provide a titanium carbonitride-based cermet cutting insert which exhibits superior toughness and improved wear resistance of the cutting edge when compared to prior art TiCN-based cermet cutting inserts.

Briefly stated, the present invention provides a wear resistant TiCN-based cermet cutting insert superior in toughness which is characterized by a binding phase anti two hard dispersion phases which coexist with each other. One hard dispersion phase is characterized by a core containing TiCN while the other hard dispersion phases includes a core containing a carbonitride solid solution of Ti and one of a V, Hf, Cr, Ta, Nb, Zr, W and Mo.

According to a feature of the present invention, there is provided a wear-resistant cutting insert made of titanium carbonitride-based cermet which includes a binding phase; which constitutes, by volume percent, from about 5 to about 30 percent of the titanium carbonitride-based cermet; the binding phase includes at least one of Ni and Co. The cutting insert also includes a first hard dispersion phase and a second hard dispersion phase.

The first dispersion phase includes at least one of a duplex and a triplex structure characterized by a core composed of titanium carbonitride, and the second hard dispersion phase includes at least one of a duplex and a triplex structure having a core composed of a carbonitride solid solution of titanium and at least one element selected from the group consisting of Ta, Nb, V, Hf, Zr, W, Mo and Cr.

According to yet another feature of the present invention, there is provides a wear resistant titanium carbonitride-based cermet cutting insert wherein the binding phase further includes, by weight percent, at least one of W, Mo, Cr, Hf, Zr, Ti, Ta, Nb and V in an amount not exceeding 40% with the balance being one of Co and Ni.

According to another feature of the present invention, there is provided a wear-resistant cutting insert made of a titanium carbonitride-based cermet which includes a binding phase which constitutes, by volume percent, from about 5 to about 30 percent of the titanium carbonitride-based cermet; the binding phase includes at least one of Ni and Co. The binding phase also includes, by volume percent, no more than 10% of fine hard particles disperged therein. The fine hard particles are composed mainly of TiN.

The cutting insert also includes a first hard dispersion phase and a second hard dispersion phase. The first dispersion phase includes at least one of a duplex and a triplex structure characterized by a core composed of titanium carbonitride, and the second hard dispersion phase includes at least one of a duplex and a triplex structure having a core composed of a carbonitride solid solution of Titanium and at least one element selected from the group consisting of Ta, Nb, V, Hf, Zr, W, Mo and Cr.

The above, and other objects, features and advantages of the present invention will become apparent from the following description.

DETAILED DESCRIPTION OF THE PREFERRED EMBODIMENTS

The inventors have discovered that the combination of two hard dispersion phases with a binding phase substantially improves the wear resistance and toughness of a TiCN-based cermet cutting insert.

The present invention aims at providing a wear resistant cutting insert made of a TiCN-based cermet which includes two coexisting hard dispersion phases in combination with a binding phase. One of the two hard dispersion phases includes one of a duplex and triplex structure characterized by a core structure composed of titanium carbonitride (hereinafter referred to as TiCN hard dispersion phase), while the other hard dispersion phase is characterized by one of a duplex and triplex structure wherein the core structure includes a carbonitride solid solution of Ti and one of a V, Hf, Cr, Ta, Nb, Zr, W and Mo (hereinafter referred to as a (Ti,M)CN hard dispersion phase).

The TiCN hard dispersion phase imparts superior wear resistant properties to the cutting insert, while the (Ti,M)CN hard dispersion phase in combination with the binding phase substantially improves the toughness of the cutting insert.

The binding phase contains of at least one of Co and Ni. The combination of the two hard dispersion phases with the binding phase provide for a long lasting cutting insert with superior toughness which is substantially resistant to breaking and/or chipping of the cutting edge when used continuously and discontinuously.

The wear resistant TiCN-based cermet cutting insert comprises 5 to 30 vol% of a binding phase, with the balance comprising the two hard dispersion phases. The binding phase is needed to impart toughness to the cutting insert. When the content of the binding phase falls below 5 vol%, superior toughness is not achieved. Similarly, when the binding phase content exceeding 30 vol%, there is a drastic reduction in wear resistance.

The binding phase may include at least one element selected from the group consisting of W, Mo, Cr, Hf, Zr, Ti, Ta, Nb and V in an amount not exceeding 40 wt%. Addition of the abovementioned element(s) in excess of 40 wt% drastically reduces the toughness of the cutting insert.

Wear resistance can be further improved by strengthening the binding phase. The strengthening of the binding phase is achieved by dispersing from about 0.1 to about 20 vol% of fine hard particles composed of TiN, in the binding phase. These fine hard particles should be finer than the hard dispersion phase and can be added in addition to the two hard dispersion phases.

Addition of the fine hard particles in excess of 20 vol%, is not preferred because they substantially reduce the toughness of the cutting insert. It is preferable than the fine hard particles be dispersed ranging from 0.1 to about 10 vol%.

It is desirable, that the content of the TiCN hard dispersion phase be from about 30 vol% to 90 vol%. However, it is preferably that the TiCN hard dispersion phase be present from 40 vol% to 70 vol%, of the total hard dispersion phase.

The cutting insert exhibits insufficient wear resistance when the TiCN hard dispersion phase is present in an amount less the 30 vol%. On the other hand, a content of more than 90 vol% drastically effects the properties of the hard dispersion phase characterized by the (Ti,M)CN core.

The lowering of the (TiCN)M hard dispersion phase to below 30 vol% impairs the toughness of the cutting insert.

This invention is illustrated in more detail by reference to the examples described hereinafter.

EXAMPLE 1

Material powders with varying compositions, as shown in Table 1 were prepared. Each of the various material powders contained numerous particles having a mean particle size ranging from about 0.5 to about 2 μm. Such material powders included powders of carbides, nitrides and carbonitrides, as well as powders of (Ti, M)CN, TiCN, Co and Ni.

Each of the compositions of Table 1 were compressed into green bodies, by being wet blended by a ball mill over a 72-hour period. After drying, the blended compositions were compression formed under a pressure of 1.5 ton/cm$^2$ to provide compressed green bodies.

The thus obtained, compacted green bodies were then sintered under either one of the following sintering condition:

NITROGEN ATMOSPHERE SINTERING

In this procedure, the compacted green bodies were heating from room temperature to 1100° C. in a nitrogen atmosphere. The nitrogen atmosphere was further maintained at 10 torr for a predetermined period of time sufficient to heat the compacted green body from 1100° C. to a predetermined sintering temperature of from 1420° to about 1500° C. The heated green body was maintained at the prescribed sintering temperature for a period of one hour and then cooled down to room temperature.

VACUUM SINTERING

In this procedure, the compacted green bodies were maintained for one hour at a predetermined temperature ranging between 1420° and 1500° C. in a vacuum of 10−3 torr.

After sintering, sample nos. 1 to 18, were obtained, each having throw-away tips which were in compliance with SNMG 432. Additionally, sample nos. 1 to 6, representing prior art TiCN-based cermet cutting inserts (hereinafter referred to as "conventional cutting inserts") were also obtained. The conventional cutting inserts were characterized by a single (Ti,M)CN hard dispersion phase.

In order to measure the content of the binding phase and the composition of the hard dispersion phases, the structures of the abovementioned samples were examined by means of an analytical electron microscope and an image analyzing apparatus.

These samples were simultaneously subjected to a discontinuous cutting test and a continuous cutting test which are described as follows:

Discontinuous cutting test included the following:

Cut material: Round bar of a steel SNCM 439 (hardness: HB 270) having three longitudinal grooves, which was cut at three points equally spaced in a longitudinal direction.

Cutting speed: 150 m/min

Penetration: 3 mm

Feed: 0.5 mm/rev

Cutting time: 5 minutes

Continuous cutting test included the following:

Cut material: Round bar of steel SNCM 439 (hardness: HB 270)

Cutting speed: 200 m/min

Penetration: 2 mm

Feed: 0.3 mm/rev

Cutting time: 20 minutes

The width of wear on the relief surface on each sample was measured after completion of each of the abovementioned tests. The results including the proportions of the binding phase and the hard dispersion phases are reported in Tables 2. The results pertaining to the analysis of the binding phase and the hard dispersion phases are reported in Tables 3–7.

TABLE 1

| | COMPOSITION (WT %) | | | | | |
|---|---|---|---|---|---|---|
| TYPE | Co | Ni | CARBIDE, NITRIDE, CARBO-NITRIDE | (Ti, M)(C, N) | TiCN | SINTERING CONDITION |
| CUTTING | 1 8 | 7 | WC:10, $Cr_3C_2$:0.5 | (Ti, W, Mo)CN:25, | Bal. | NITROGEN |

TABLE 1-continued

| TYPE | | COMPOSITION (WT %) Co | Ni | CARBIDE, NITRIDE, CARBO-NITRIDE | (Ti, M)(C, N) | TiCN | SINTERING CONDITION |
|---|---|---|---|---|---|---|---|
| INSERT | | | | | (Ti, Ta)CN:20 | | ATMOSPHERE |
| OF THE | 2 | 10 | 5 | TiN:5, (W, Mo)C:15, ZrC:2 | (Ti, Nb)CN:25 | Bal. | |
| INVENTION | 3 | — | 15 | (W, Mo)C:15, (Ta, Nb)C:10 | (Ti, W, Ta)CN:10, (Ti, Mo)CN:5, (Ti, Zr)CN:5 | Bal. | |
| | 4 | 15 | — | TiN:10, WC:10, NbC:5 | (Ti, Mo, Nb)CN:10 | Bal. | |
| | 5 | 5 | 10 | WC:10, NbC:10, VC:2 | (Ti, W, Mo)CN:20 | Bal. | |
| | 6 | 10 | 5 | WC:10, (Ta, Nb)C:15 | (Ti, W, Ta)CN:10 | Bal. | |
| | 7 | — | 15 | WC:15, $Mo_2C$:5, TaC:5, VC:2 | (Ti, W, Nb)CN:15 | Bal. | |
| | 8 | 15 | — | TiN:10, WC:10, TaC:5 | (Ti, Mo, Ta)CN:20 | Bal. | |
| | 9 | 7 | 8 | WC:10, $Mo_2C$:5, NbCN:15 | (Ti, W)CN:15 | Bal. | |
| | 10 | 10 | 5 | WC:15, NbCN:10, ZrCN:1 | (Ti, W, Mo)CN:20 | Bal. | |
| | 11 | 15 | 15 | TiN:10, NbCN:5, VC:2 | (Ti, W, Nb)CN:5, (Ti, Zr)CN:5 | Bal. | |
| | 12 | 25 | — | TiN:7, (Ta, Nb)C:10, ZrCN:1, $Cr_3C_2$:0.5 | (Ti, W, Ta, Hf)CN:5 | Bal. | |
| | 13 | 5 | 10 | (W, Mo)C:15, TaC:10 | (Ti, Mo, Zr)CN:40 | Bal. | |
| | 14 | 5 | 5 | TaN:10 | (Ti, W, Ta)CN:35, (Ti, Mo)CN:10 | Bal. | |
| | 15 | 10 | 10 | NbCN:15, VC:2 | (Ti, Mo, Nb)CN:20 | Bal. | |
| | 16 | 10 | — | WC:5, $Mo_2C$:5, (Ta, Nb)C:20 | (Ti, W)CN:35 | Bal. | |
| | 17 | 10 | 5 | (W, Mo, Ta, Nb, Zr)CN:25 | (Ti, W)CN:20, (Ti, Ta, Nb)CN:20 | Bal. | |
| | 18 | 15 | 10 | TiN:10, $Mo_2C$:10, NbCN:5 | (Ti, W, Mo, Ta)CN:20 | Bal. | |
| CONVENTIONAL | 1 | 25 | — | (Ta, Nb)C:10, ZrCN:1, $Cr_3C_2$:0.5 | (Ti, W, Ta, Hf)CN:Bal. | — | |
| CUTTING | 2 | 5 | 10 | (W, Mo)C:15, TaC:10 | (Ti, Zr, Mo)CN:Bal. | — | |
| INSERT | 3 | 10 | — | WC:5, $Mo_2C$:5, (Ta, Nb)C:20 | (Ti, W)CN:Bal. | — | |
| | 4 | 15 | 15 | NbCN:10, VC:2 | (Ti, W, Nb)CN:10, (Ti, Zr)CN:10 | Bal. | VACUUM |
| | 5 | 5 | 20 | WC:10, TaC:5 | (Ti, W, Mo)CN:30 | Bal. | |
| | 6 | 7 | 8 | NbCN:10, VC:2 | (Ti, Mo)CN:35 | Bal. | |

TABLE 2

| TYPE | | PROPORTION OF BINDING PHASE (VOL %) | PROPORTION TO HARD DISPERSION PHASE (VOL %) CORE TiCN DUPLEX | CORE TiCN TRIPLEX | CORE (Ti, M)(C,N) DUPLEX | CORE (Ti, M)(C,N) TRIPLEX | FINE SINGLE PHASE COMPOSED OF TIN |
|---|---|---|---|---|---|---|---|
| CUTTING | 1 | 10 | — | 32 | 25 | 43 | — |
| INSERT | 2 | 11 | — | 44 | 29 | 24 | 3 |
| OF THE | 3 | 10 | — | 53 | 16 | 31 | — |
| INVENTION | 4 | 12 | — | 66 | 13 | 16 | 5 |
| | 5 | 11 | — | 55 | 19 | 26 | — |
| | 6 | 10 | — | 63 | 26 | 11 | — |
| | 7 | 11 | — | 53 | 34 | 13 | — |
| | 8 | 11 | — | 59 | 38 | — | 3 |
| | 9 | 10 | — | 54 | 46 | — | — |
| | 10 | 10 | — | 51 | 49 | — | — |
| | 11 | 24 | 79 | — | 13 | — | 8 |
| | 12 | 21 | 86 | — | — | 11 | 3 |
| | 13 | 9 | — | 38 | — | 62 | — |
| | 14 | 6 | 32 | — | 51 | 17 | — |
| | 15 | 16 | 58 | 14 | 28 | — | — |
| | 16 | 8 | 23 | 11 | — | 66 | — |
| | 17 | 11 | 9 | 27 | 32 | 32 | — |
| | 18 | 19 | 5 | 46 | 36 | 8 | 5 |
| CONVENTIONAL | 1 | 18 | — | — | — | 100 | — |
| CUTTING | 2 | 12 | — | — | — | 100 | — |
| INSERT | 3 | 8 | — | — | — | 100 | — |
| | 4 | 23 | — | — | 100 | — | — |
| | 5 | 18 | — | — | 100 | — | — |
| | 6 | 11 | — | — | 100 | — | — |

| TYPE | | WIDTH OF WEAR OF RELIEF SURFASE (mm) CONTINUOUS CUTTING | DISCONTINUOUS CUTTING |
|---|---|---|---|
| CUTTING | 1 | 0.32 | 0.20 |
| INSERT | 2 | 0.25 | 0.17 |
| OF THE | 3 | 0.22 | 0.18 |
| INVENTION | 4 | 0.20 | 0.15 |
| | 5 | 0.23 | 0.17 |
| | 6 | 0.22 | 0.16 |
| | 7 | 0.29 | 0.18 |
| | 8 | 0.25 | 0.16 |
| | 9 | 0.26 | 0.18 |
| | 10 | 0.32 | 0.19 |
| | 11 | 0.34 | 0.21 |

TABLE 2-continued

| | | | |
|---|---|---|---|
| | 12 | 0.33 | 0.20 |
| | 13 | 0.24 | 0.17 |
| | 14 | 0.23 | 0.15 |
| | 15 | 0.24 | 0.19 |
| | 16 | 0.22 | 0.16 |
| | 17 | 0.25 | 0.18 |
| | 18 | 0.28 | 0.20 |
| CONVENTIONAL CUTTING INSERT | 1 | 0.61 | 0.35 |
| | 2 | 0.59 | 0.38 |
| | 3 | 0.53 | 0.37 |
| | 4 | 0.62 | BROKEN IN ABOUT 1 MIN. |
| | 5 | 0.60 | BROKEN IN ABOUT 1 MIN. |
| | 6 | 0.56 | BROKEN IMMEDIATELY AFTER START |

TABLE 3

| TYPE | | COMPOSITION OF BINDING PHASE (WT %) | | | | | | | | | | |
|---|---|---|---|---|---|---|---|---|---|---|---|---|
| | | Co | Ni | Ti | Ta | Nb | V | Hf | Zr | W | Mo | Cr |
| CUTTING INSERT OF THE INVENTION | 1 | 44.4 | 36.6 | 0.4 | 0.4 | — | — | — | — | 10.1 | 7.9 | 0.2 |
| | 2 | 54.7 | 27.4 | 1.0 | — | 0.8 | — | — | 0.2 | 8.8 | 7.1 | — |
| | 3 | — | 88.1 | 0.5 | 0.2 | 0.4 | — | — | 0.0 | 9.3 | 1.5 | — |
| | 4 | 82.2 | — | 1.3 | — | 0.7 | — | — | — | 7.6 | 8.2 | — |
| | 5 | 20.7 | 42.4 | 0.4 | — | 0.8 | 0.2 | — | — | 23.1 | 12.4 | — |
| | 6 | 57.9 | 29.0 | 1.2 | 0.8 | 0.2 | — | — | — | 10.9 | — | — |
| | 7 | — | 80.5 | 0.4 | 0.2 | 0.6 | 0.6 | — | — | 14.3 | 3.4 | — |
| | 8 | 79.7 | — | 1.4 | 0.0 | — | — | — | — | 12.8 | 6.1 | — |
| | 9 | 32.8 | 38.4 | 0.5 | — | 0.6 | — | — | — | 23.4 | 4.3 | — |
| | 10 | 54.7 | 25.9 | 0.4 | — | 0.6 | — | — | 0.0 | 11.6 | 6.8 | — |
| | 11 | 47.1 | 45.0 | 0.6 | — | 0.4 | 0.5 | — | 0.0 | 6.4 | — | — |
| | 12 | 84.5 | — | 1.3 | 0.4 | 0.2 | — | 0.1 | 0.0 | 13.2 | — | 0.3 |
| | 13 | 23.9 | 50.7 | 2.1 | 0.3 | — | — | — | 0.2 | 10.1 | 12.7 | — |
| | 14 | 46.4 | 44.5 | 2.0 | 0.2 | — | — | — | — | 4.8 | 2.1 | — |
| | 15 | 44.0 | 45.9 | 1.3 | — | 0.6 | 0.9 | — | — | — | 7.3 | — |
| | 16 | 60.7 | — | 1.8 | 0.5 | 0.3 | — | — | — | 31.2 | 5.5 | — |
| | 17 | 52.8 | 27.3 | 0.8 | 0.2 | 0.1 | — | — | 0.1 | 15.8 | 2.9 | — |
| | 18 | 48.1 | 31.7 | 0.8 | 0.5 | 0.3 | — | — | — | 16.1 | 2.5 | — |
| CONVENTIONAL CUTTING INSERT | 1 | 81.7 | — | 1.5 | 0.6 | 0.4 | — | 0.1 | 0.0 | 15.5 | — | 0.2 |
| | 2 | 24.2 | 45.7 | 2.3 | 0.5 | — | — | — | 0.2 | 12.1 | 15.0 | — |
| | 3 | 62.8 | — | 1.7 | 0.5 | 0.4 | — | — | — | 29.8 | 4.8 | — |
| | 4 | 47.3 | 43.6 | 0.9 | — | 0.8 | 0.5 | — | 0.0 | 6.9 | — | — |
| | 5 | 15.7 | 64.4 | 2.2 | 0.3 | — | — | — | — | 13.1 | 4.3 | — |
| | 6 | 41.9 | 45.5 | 1.8 | — | 0.8 | 0.9 | — | — | — | 9.1 | — |

TABLE 4

| TYPE | | COMPOSITION OF DUPLEX HARD DISPERSION PHASE HAVING A CORE TiCN (WT %) | | | | | | | | | | | | | | | | | |
|---|---|---|---|---|---|---|---|---|---|---|---|---|---|---|---|---|---|---|---|
| | | CORE | | | | | | | | | SURROUNDING STRUCTURE | | | | | | | | |
| | | Ti | Ta | Nb | V | Hf | Zr | W | Mo | Cr | Ti | Ta | Nb | V | Hf | Zr | W | Mo | Cr |
| CUTTING INSERT OF THE INVENTION | 1 | — | — | — | — | — | — | — | — | — | — | — | — | — | — | — | — | — | — |
| | 2 | — | — | — | — | — | — | — | — | — | — | — | — | — | — | — | — | — | — |
| | 3 | — | — | — | — | — | — | — | — | — | — | — | — | — | — | — | — | — | — |
| | 4 | — | — | — | — | — | — | — | — | — | — | — | — | — | — | — | — | — | — |
| | 5 | — | — | — | — | — | — | — | — | — | — | — | — | — | — | — | — | — | — |
| | 6 | — | — | — | — | — | — | — | — | — | — | — | — | — | — | — | — | — | — |
| | 7 | — | — | — | — | — | — | — | — | — | — | — | — | — | — | — | — | — | — |
| | 8 | — | — | — | — | — | — | — | — | — | — | — | — | — | — | — | — | — | — |
| | 9 | — | — | — | — | — | — | — | — | — | — | — | — | — | — | — | — | — | — |
| | 10 | — | — | — | — | — | — | — | — | — | — | — | — | — | — | — | — | — | — |
| | 11 | 100.0 | — | 0.0 | 0.0 | — | 0.0 | 0.0 | — | — | 71.4 | — | 21.3 | 1.3 | — | 0.7 | 5.3 | — | — |
| | 12 | 100.0 | 0.0 | 0.0 | — | 0.0 | 0.0 | 0.0 | — | 0.0 | 58.3 | 13.4 | 8.5 | — | 0.5 | 0.5 | 18.8 | — | 0.0 |
| | 13 | — | — | — | — | — | — | — | — | — | — | — | — | — | — | — | — | — | — |
| | 14 | 98.8 | 0.3 | — | — | — | — | 0.6 | 0.3 | — | 75.4 | 15.1 | — | — | — | — | 5.2 | 4.3 | — |
| | 15 | 100.0 | — | 0.0 | 0.0 | — | — | — | 0.0 | — | 74.1 | — | 18.3 | 0.5 | — | — | — | 7.1 | — |
| | 16 | 100.0 | 0.0 | 0.0 | — | — | — | 0.0 | 0.0 | — | 56.6 | 10.2 | 7.8 | — | — | — | 20.1 | 5.3 | — |
| | 17 | 100.0 | 0.0 | 0.0 | — | — | 0.0 | 0.0 | 0.0 | — | 60.9 | 6.3 | 5.8 | — | — | 0.5 | 23.4 | 3.1 | — |
| | 18 | 99.6 | 0.0 | 0.0 | — | — | — | 0.4 | 0.0 | — | 66.7 | 4.9 | 5.8 | — | — | — | 2.5 | 20.1 | — |

TABLE 5

| TYPE | COMPOSITION OF TRIPLEX HARD DISPERSION PHASE HAVING A CORE TiCN (WT %) | | | | | | | | | | | | | | |
|---|---|---|---|---|---|---|---|---|---|---|---|---|---|---|---|
| | CORE | | | | | | | | | INTERMEDIATE LAYER | | | | | |
| | Ti | Ta | Nb | V | Hf | Zr | W | Mo | Cr | Ti | Ta | Hb | V | Hf | Zr |

TABLE 5-continued

| | | | | | | | | | | | | | | | | |
|---|---|---|---|---|---|---|---|---|---|---|---|---|---|---|---|---|
| CUTTING | 1 | 100.0 | 0.0 | — | — | — | — | 0.0 | 0.0 | 0.0 | 55.4 | 8.7 | — | — | — | — |
| INSERT | 2 | 100.0 | — | 0.0 | — | — | 0.0 | 0.0 | 0.0 | — | 57.2 | — | 4.0 | — | — | 0.6 |
| OF THE | 3 | 100.0 | 0.0 | 0.0 | — | — | 0.0 | 0.0 | 0.0 | — | 54.8 | 10.3 | 8.5 | — | — | 0.5 |
| INVENTION | 4 | 100.0 | — | 0.0 | — | — | — | 0.0 | 0.0 | — | 58.4 | — | 19.3 | — | — | — |
| | 5 | 99.2 | — | 0.0 | 0.0 | — | — | 0.8 | 0.0 | — | 56.7 | — | 17.5 | 0.2 | — | — |
| | 6 | 98.4 | 0.2 | 0.0 | — | — | — | 1.4 | — | — | 52.5 | 20.7 | 8.3 | — | — | — |
| | 7 | 95.7 | 0.2 | 0.0 | 0.0 | — | — | 2.9 | 1.2 | — | 44.8 | 20.4 | 5.1 | 0.4 | — | — |
| | 8 | 100.0 | 0.0 | — | — | — | — | 0.0 | 0.0 | — | 56.6 | 12.4 | — | — | — | — |
| | 9 | 98.9 | — | 0.0 | — | — | — | 0.8 | 0.3 | — | 49.9 | — | 20.3 | — | — | — |
| | 10 | 96.1 | — | 0.2 | — | — | 0.0 | 2.8 | 0.9 | — | 51.1 | — | 18.7 | — | — | 0.2 |
| | 11 | — | — | — | — | — | — | — | — | — | — | — | — | — | — | — |
| | 12 | — | — | — | — | — | — | — | — | — | — | — | — | — | — | — |
| | 13 | 98.7 | 0.0 | — | — | — | 0.0 | 0.8 | 0.5 | — | 40.2 | 18.1 | — | — | — | 0.8 |
| | 14 | — | — | — | — | — | — | — | — | — | — | — | — | — | — | — |
| | 15 | 100.0 | — | 0.0 | 0.0 | — | — | — | 0.0 | — | 62.0 | — | 30.1 | 0.4 | — | — |
| | 16 | 100.0 | 0.0 | 0.0 | — | — | — | 0.0 | 0.0 | — | 38.0 | 10.5 | 9.8 | — | — | — |
| | 17 | 100.0 | 0.0 | 0.0 | — | — | 0.0 | 0.0 | 0.0 | — | 49.6 | 8.5 | 7.9 | — | — | 0.4 |
| | 18 | 96.3 | 0.0 | 0.6 | — | — | — | 1.1 | 2.0 | — | 55.9 | 5.8 | 8.1 | — | — | — |

| | | INTERMEDIATE LAYER | | | SURROUNDING STRUCTURE | | | | | | | | |
|---|---|---|---|---|---|---|---|---|---|---|---|---|---|
| TYPE | | W | Mo | Cr | Ti | Ta | Nb | V | Hf | Zr | W | Mo | Cr |
| CUTTING | 1 | 30.5 | 5.0 | 0.4 | 67.0 | 7.5 | — | — | — | — | 21.4 | 3.7 | 0.4 |
| INSERT | 2 | 17.4 | 20.8 | — | 67.4 | — | 11.3 | — | — | 0.4 | 9.5 | 11.4 | — |
| OF THE | 3 | 23.3 | 2.6 | — | 61.5 | 8.1 | 7.9 | — | — | 0.4 | 19.8 | 2.3 | — |
| INVENTION | 4 | 17.5 | 4.8 | — | 67.4 | — | 8.2 | — | — | — | 21.0 | 3.4 | — |
| | 5 | 21.8 | 3.8 | — | 66.2 | — | 11.4 | | — | — | 15.9 | 6.5 | — |
| | 6 | 18.5 | — | — | 63.8 | 14.1 | 7.3 | — | — | — | 14.8 | — | — |
| | 7 | 22.0 | 7.3 | — | 66.4 | 11.4 | 2.8 | | — | — | 15.3 | 4.1 | — |
| | 8 | 20.6 | 10.4 | — | 62.3 | 11.1 | — | — | — | — | 16.9 | 9.7 | — |
| | 9 | 21.4 | 8.4 | — | 68.0 | — | 14.3 | — | — | — | 10.4 | 7.3 | — |
| | 10 | 26.2 | 3.8 | — | 72.7 | — | 6.5 | — | — | 0.4 | 18.3 | 2.1 | — |
| | 11 | — | — | — | — | — | — | — | — | — | — | — | — |
| | 12 | — | — | — | — | — | — | — | — | — | — | — | — |
| | 13 | 21.3 | 19.6 | — | 45.1 | 16.4 | — | — | — | 0.7 | 18.7 | 19.1 | — |
| | 14 | — | — | — | — | — | — | — | — | — | — | — | — |
| | 15 | — | 7.5 | — | 75.6 | — | 17.6 | 0.4 | — | — | — | 6.4 | — |
| | 16 | 35.4 | 6.3 | — | 56.6 | 8.3 | 7.1 | — | — | — | 22.2 | 5.8 | — |
| | 17 | 29.5 | 4.1 | — | 64.2 | 6.3 | 6.2 | — | — | 0.4 | 20.1 | 2.8 | — |
| | 18 | 4.9 | 25.3 | — | 62.3 | 4.1 | 6.6 | — | — | — | 2.7 | 24.3 | — |

TABLE 6

| | | COMPOSITION OF DUPLEX HARD DISPERSION PHASE HAVING A CORE (Ti, M)(C, N) (WT %) | | | | | | | | | | | | | | | | | |
|---|---|---|---|---|---|---|---|---|---|---|---|---|---|---|---|---|---|---|---|
| | | CORE | | | | | | | | | SURROUNDING STRUCTURE | | | | | | | | |
| TYPE | | Ti | Ta | Nb | V | Hf | Zr | W | Mo | Cr | Ti | Ta | Nb | V | Hf | Zr | W | Mo | Cr |
| CUTTING | 1 | 71.4 | 7.2 | — | — | — | — | 12.7 | 8.4 | 0.3 | 56.8 | 10.9 | — | — | — | — | 20.4 | 11.6 | 0.3 |
| INSERT | 2 | 75.8 | — | 3.8 | — | — | 0.3 | 10.4 | 9.7 | — | 59.6 | — | 22.3 | — | — | 0.5 | 9.4 | 8.2 | — |
| OF THE | 3 | 61.3 | 13.6 | 4.2 | — | — | 0.4 | 15.0 | 5.5 | — | 50.8 | 20.5 | 5.5 | — | — | 0.0 | 19.1 | 4.1 | — |
| INVENTION | 4 | 67.0 | — | 13.9 | — | — | — | 14.3 | 4.8 | — | 56.9 | — | 18.1 | — | — | — | 18.8 | 6.2 | — |
| | 5 | 60.6 | — | 19.2 | 0.0 | — | — | 8.9 | 11.3 | — | 45.3 | — | 20.1 | 0.5 | — | — | 25.3 | 8.8 | — |
| | 6 | 52.8 | 18.7 | 15.1 | — | — | — | 13.4 | — | — | 66.5 | 10.2 | 8.1 | — | — | — | 15.2 | — | — |
| | 7 | 44.9 | 15.7 | 2.4 | 0.4 | — | — | 26.5 | 10.1 | — | 59.8 | 7.9 | 5.8 | 0.6 | — | — | 20.4 | 5.5 | — |
| | 8 | 38.1 | 15.9 | — | — | — | — | 36.8 | 9.2 | — | 71.9 | 8.6 | — | — | — | — | 13.3 | 6.2 | — |
| | 9 | 47.1 | — | 25.4 | — | — | — | 20.1 | 7.4 | — | 72.6 | — | 12.4 | — | — | — | 11.8 | 3.2 | — |
| | 10 | 48.4 | — | 26.5 | — | — | 0.3 | 21.6 | 3.2 | — | 64.6 | — | 15.3 | — | — | 0.4 | 14.8 | 4.9 | — |
| | 11 | 42.9 | — | 30.3 | 0.4 | — | 0.0 | 26.4 | — | — | 60.6 | — | 23.1 | 0.5 | — | 0.4 | 15.4 | — | — |
| | 12 | — | — | — | — | — | — | — | — | — | — | — | — | — | — | — | — | — | — |
| | 13 | — | — | — | — | — | — | — | — | — | — | — | — | — | — | — | — | — | — |
| | 14 | 32.9 | 46.1 | — | — | — | — | 15.2 | 5.8 | — | 75.4 | 18.3 | — | — | — | — | 4.1 | 2.2 | — |
| | 15 | 50.5 | — | 35.4 | 0.7 | — | — | — | 13.4 | — | 64.3 | — | 24.4 | 0.5 | — | — | — | 10.8 | — |
| | 16 | — | — | — | — | — | — | — | — | — | — | — | — | — | — | — | — | — | — |
| | 17 | 52.9 | 13.4 | 9.2 | — | — | 0.8 | 18.1 | 5.6 | — | 41.4 | 15.1 | 4.5 | — | — | 0.7 | 27.9 | 10.4 | — |
| | 18 | 66.1 | 5.8 | 6.4 | — | — | — | 11.4 | 10.3 | — | 55.3 | 3.4 | 18.2 | — | — | — | 8.1 | 15.0 | — |
| CONVENTIONAL | 1 | — | — | — | — | — | — | — | — | — | — | — | — | — | — | — | — | — | — |
| CUTTING | 2 | — | — | — | — | — | — | — | — | — | — | — | — | — | — | — | — | — | — |
| INSERT | 3 | — | — | — | — | — | — | — | — | — | — | — | — | — | — | — | — | — | — |
| | 4 | 36.9 | — | 34.6 | 0.8 | — | 0.0 | 27.7 | — | — | 53.4 | — | 22.2 | 0.7 | — | 0.4 | 23.3 | — | — |
| | 5 | 34.2 | 21.3 | — | — | — | — | 26.4 | 18.1 | — | 74.9 | 11.6 | — | — | — | — | 3.1 | 10.4 | — |
| | 6 | 52.0 | — | 33.1 | 0.4 | — | — | — | 14.5 | — | 70.8 | — | 15.3 | 0.4 | — | — | — | 13.5 | — |

TABLE 7

| | COMPOSITON OF TRIPLEX HARD DISPERSION PHASE HAVING A CORE (Ti, M) (C, N) (WT %) | | | | | | | | | | | | | | |
|---|---|---|---|---|---|---|---|---|---|---|---|---|---|---|---|
| | CORE | | | | | | | | | INTERMEDIATE LAYER | | | | | |
| TYPE | Ti | Ta | Nb | V | Hf | Zr | W | Mo | Cr | Ti | Ta | Nb | V | Hf | Zr |

TABLE 7-continued

| | | | | | | | | | | | | | | | | |
|---|---|---|---|---|---|---|---|---|---|---|---|---|---|---|---|---|
| CUTTING | 1 | 66.1 | 10.0 | — | — | — | — | 12.8 | 11.1 | 0.0 | 52.8 | 8.4 | — | — | — | — |
| INSERT | 2 | 55.4 | — | 26.4 | — | — | 0.2 | 9.7 | 8.3 | — | 48.9 | — | 20.1 | — | — | 1.8 |
| OF THE | 3 | 57.2 | 11.4 | 5.7 | — | — | 1.3 | 19.6 | 4.8 | — | 41.6 | 14.8 | 7.2 | — | — | 0.6 |
| INVENTION | 4 | 64.8 | — | 10.1 | — | — | — | 9.8 | 15.3 | — | 43.0 | — | 21.7 | — | — | — |
| | 5 | 62.5 | — | 6.1 | 0.4 | — | — | 18.3 | 12.7 | — | 48.3 | — | 14.8 | 0.2 | — | — |
| | 6 | 62.2 | 15.6 | 2.3 | — | — | — | 19.9 | — | — | 44.5 | 22.4 | 12.3 | — | — | — |
| | 7 | 59.4 | 2.0 | 14.3 | 0.4 | — | — | 20.1 | 3.8 | — | 37.9 | 12.3 | 11.1 | 0.4 | — | — |
| | 8 | — | — | — | — | — | — | — | — | — | — | — | — | — | — | — |
| | 9 | — | — | — | — | — | — | — | — | — | — | — | — | — | — | — |
| | 10 | — | — | — | — | — | — | — | — | — | — | — | — | — | — | — |
| | 11 | — | — | — | — | — | — | — | — | — | — | — | — | — | — | — |
| | 12 | 56.7 | 14.8 | 3.6 | — | 0.2 | 0.2 | 24.5 | — | 0.0 | 33.8 | 26.1 | 9.9 | — | 0.0 | 0.2 |
| | 13 | 74.3 | 3.4 | — | — | — | 2.1 | 6.9 | 13.3 | — | 33.3 | 25.0 | — | — | — | 0.9 |
| | 14 | 61.4 | 13.7 | — | — | — | — | 18.8 | 6.1 | — | 45.0 | 28.6 | — | — | — | — |
| | 15 | — | — | — | — | — | — | — | — | — | — | — | — | — | — | — |
| | 16 | 41.6 | 13.0 | 9.8 | — | — | — | 30.8 | 4.8 | — | 17.0 | 27.1 | 13.4 | — | — | — |
| | 17 | 52.8 | 12.7 | 10.3 | — | — | 1.0 | 19.9 | 3.3 | — | 38.5 | 16.2 | 11.4 | — | — | 0.3 |
| | 18 | 65.2 | 6.4 | 4.1 | — | — | — | 11.0 | 13.3 | — | 46.4 | 8.0 | 12.7 | — | — | — |
| CONVENTIONAL | 1 | 48.1 | 21.8 | 2.3 | — | 0.4 | 0.0 | 27.4 | — | 0.0 | 37.5 | 23.3 | 16.4 | — | 0.2 | 0.0 |
| CUTTING | 2 | 69.1 | 4.9 | — | — | — | 0.9 | 8.7 | 16.4 | — | 39.4 | 20.2 | — | — | — | 0.4 |
| INSERT | 3 | 52.4 | 10.7 | 7.4 | — | — | — | 26.4 | 3.1 | — | 40.6 | 19.9 | 10.3 | — | — | — |
| | 4 | — | — | — | — | — | — | — | — | — | — | — | — | — | — | — |
| | 5 | — | — | — | — | — | — | — | — | — | — | — | — | — | — | — |
| | 6 | — | — | — | — | — | — | — | — | — | — | — | — | — | — | — |

| | | INTERMEDIATE LAYER | | | SURROUNDING STRUCTURE | | | | | | | | |
|---|---|---|---|---|---|---|---|---|---|---|---|---|---|
| TYPE | | W | Mo | Cr | Ti | Ta | Nb | V | Hf | Zr | W | Mo | Cr |
| CUTTING | 1 | 28.9 | 10.1 | 0.0 | 60.9 | 5.4 | — | — | — | — | 22.0 | 11.3 | 0.4 |
| INSERT | 2 | 14.1 | 15.1 | — | 53.5 | — | 22.8 | — | — | 0.6 | 12.3 | 10.8 | — |
| OF THE | 3 | 30.1 | 5.7 | — | 51.1 | 9.8 | 6.3 | — | — | 0.4 | 25.5 | 6.9 | — |
| INVENTION | 4 | 21.5 | 13.0 | — | 55.6 | — | 15.4 | — | — | — | 16.6 | 12.4 | — |
| | 5 | 25.3 | 11.4 | — | 57.4 | — | 10.3 | 0.3 | — | — | 23.3 | 8.7 | — |
| | 6 | 20.8 | — | — | 54.5 | 15.4 | 10.1 | — | — | — | 20.0 | — | — |
| | 7 | 29.6 | 8.7 | — | 53.6 | 10.4 | 9.8 | 0.3 | — | — | 18.6 | 7.3 | — |
| | 8 | — | — | — | — | — | — | — | — | — | — | — | — |
| | 9 | — | — | — | — | — | — | — | — | — | — | — | — |
| | 10 | — | — | — | — | — | — | — | — | — | — | — | — |
| | 11 | — | — | — | — | — | — | — | — | — | — | — | — |
| | 12 | 29.8 | — | 0.2 | 43.9 | 15.0 | 8.4 | — | 0.4 | 0.2 | 32.1 | — | 0.0 |
| | 13 | 30.4 | 10.4 | — | 48.6 | 22.8 | — | — | — | 0.4 | 21.4 | 6.8 | — |
| | 14 | 19.1 | 7.3 | — | 52.4 | 25.9 | — | — | — | — | 16.0 | 5.7 | — |
| | 15 | — | — | — | — | — | — | — | — | — | — | — | — |
| | 16 | 25.1 | 17.4 | — | 29.7 | 21.9 | 10.4 | — | — | — | 27.6 | 10.4 | — |
| | 17 | 28.4 | 5.2 | — | 44.3 | 12.1 | 12.9 | — | — | 0.6 | 25.4 | 4.7 | — |
| | 18 | 13.3 | 19.6 | — | 53.6 | 5.8 | 15.1 | — | — | — | 10.4 | 15.1 | — |
| CONVENTIONAL | 1 | 22.6 | — | 0.0 | 44.8 | 15.4 | 15.9 | — | 0.4 | 0.0 | 23.3 | — | 0.2 |
| CUTTING | 2 | 29.4 | 10.6 | — | 55.6 | 20.5 | — | — | — | 0.4 | 15.4 | 8.1 | — |
| INSERT | 3 | 20.8 | 8.4 | — | 47.4 | 13.3 | 10.6 | — | — | — | 22.4 | 6.3 | — |
| | 4 | — | — | — | — | — | — | — | — | — | — | — | — |
| | 5 | — | — | — | — | — | — | — | — | — | — | — | — |
| | 6 | — | — | — | — | — | — | — | — | — | — | — | — |

Sample nos. 1–18 represent cutting inserts of the present invention. Essentially, each of the samples is characterized by a binding phase and two coexisting hard dispersion phases. One of the two hard dispersion phases includes one of a duplex and a triplex structure wherein the core is composed of TiCN, while the other dispersion phase includes one of a duplex and a triplex wherein the core is represented by (Ti,M)CN.

It is clear from Table 2 that samples 1–18 did not undergo any damage, such as breakage or chipping of the cutting edge. These results lend credence to the notion that TiCN-based cermet cutting inserts of the present invention are superior in toughness when compared to conventional samples 1–6, which are characterized by a single hard dispersion phase to wit:- (Ti,M)CN.

Additionally, samples 1–18 exhibited excellent wear resistant during continuous cutting, when compared to conventional samples 1–6.

As has been described, the TiCN-based cermet cutting insert of the present invention excels both in wear resistance and toughness. It exhibits improved resistance to wear and tear damage such as breakage and/or chipping of the cutting edge when in continuous and discontinuous use. These features, in turn, impart excellent cutting properties to the cutting insert and substantially increase its life expectancy.

Having described preferred embodiments of the present invention, it is to be understood that the invention is not limited to those precise embodiments, and that various changes and modifications may be effected by one skilled in the art without departing from the scope or spirit of the invention as defined in the appended claims.

What is claimed:

1. A cutting insert made of a titanium carbonitride-based cermet comprising:

from 5 to 30 volume percent of a binding phase consisting of at least one of a Ni and Co;

from about 30 to about 90 volume percent of a first hard dispersion phase having at least one of a duplex and a triplex structure comprising a core of TiCN; and a balance of a second hard dispersion phase having at least one of a duplex and a triplex structure comprising a core of a carbonitride of a solid solution of Ti and at least one element selected from the group consisting of Ta, Nb, V, Hf, Zr, W, Mo and Cr.

2. The cutting insert of claim 1, wherein said binding phase further includes, by weight percent, from about 0 to about 40% of at least one of W, Mo, Cr, Hf, Zr, Ti, Ta, Nb and V and a balance of at least one Co and Ni.

3. The cutting insert of claim 1, wherein said first hard dispersion phase being, in volume percent, from about 40 to about 70 percent of said hard dispersion phases.

4. A cutting insert made of a titanium carbonitride-based cermet comprising:

from about 5 to about 30 volume percent of a binding phase comprising at least one of Ni and Co;

from about 30 to about 90 volume percent of a first hard dispersion phase having at least one of duplex and a triplex structure comprising a core of TiCN; and a balance of a second hard dispersion phase having at least one of a duplex and a triplex structure comprising a core of a carbonitride of a solid solution of Ti and at least one element selected from the group consisting of Ta, Nb, V, Hf, Zr, W, Mo and Cr.

5. The cutting insert of claim 4, wherein said binding phase further includes, by weight percent, from about 0 to about 40 % of at least one element selected from the group consisting of W, Mo, Cr, Hf, Zr, Ti, Ta, Nb and V and a balance of at least one of Co and Ni.

6. The cutting insert of claim 4, wherein from about 0.1 to about 10 volume percent of fine particles of TiCN are dispersed in said binding phase.

7. The cutting insert of claim 4, comprising from about 40 to about 70 volume percent of said first hard dispersion phase.

* * * * *